US010238985B2

(12) United States Patent
Hui

(10) Patent No.: US 10,238,985 B2
(45) Date of Patent: Mar. 26, 2019

(54) HARD-CORE AND SOFT-SHELL TOY BUILDING BLOCKS SET

(71) Applicant: Chi Keung Raymond Hui, Hong Kong (CN)

(72) Inventor: Chi Keung Raymond Hui, Hong Kong (CN)

(73) Assignee: Vault Limited, Macau (CN)

( * ) Notice: Subject to any disclaimer, the term of this patent is extended or adjusted under 35 U.S.C. 154(b) by 0 days.

(21) Appl. No.: 15/118,001

(22) PCT Filed: Nov. 19, 2015

(86) PCT No.: PCT/CN2015/094986

§ 371 (c)(1),
(2) Date: Aug. 10, 2016

(87) PCT Pub. No.: WO2016/161806

PCT Pub. Date: Oct. 13, 2016

(65) Prior Publication Data

US 2018/0193762 A1 Jul. 12, 2018

(30) Foreign Application Priority Data

Apr. 10, 2015 (CN) ..... 2015 2 0215068 U

(51) Int. Cl.

| | |
|---|---|
| ***A63H 33/08*** | (2006.01) |
| ***A63H 33/06*** | (2006.01) |
| *E04B 1/14* | (2006.01) |

(52) U.S. Cl.
CPC ..... *A63H 33/08* (2013.01); *A63H 33/065* (2013.01)

(58) Field of Classification Search
CPC ..... A63H 33/00; A63H 33/04; A63H 33/067; A63H 33/086; A63H 33/042; A63H 33/08;
(Continued)

(56) References Cited

U.S. PATENT DOCUMENTS 4,691,828 A * 9/1987 Slusarczyk ..... B65D 21/0231 206/509
4,964,833 A * 10/1990 Suzuki ..... A63H 33/086 446/118
(Continued)

FOREIGN PATENT DOCUMENTS

CN 202342898 U 7/2012
CN 104107553 A 10/2014
(Continued)

*Primary Examiner* — Kien Nguyen
(74) *Attorney, Agent, or Firm* — Bay State IP, LLC

(57) ABSTRACT

The present application relates to a hard-core and soft-shell toy building blocks set, comprising polycarbonate matrix having tenon on its top and several mortise holes on its bottom; the outside surface of said polycarbonate matrix is cladded with thermoplastic polyurethane elastomer rubber layer. Said hard-core and soft-shell toy building blocks set provided in the this embodiment unitizes both conventional hard and soft kinds of cordwood toy by cladding thermoplastic polyurethane elastomer rubber layer on the outside surface of polycarbonate matrix, learning strong points from both to overcome their weaknesses, it produces high bounce ability, high resistance to wearing, bending, high temperature and oxidation, particularly, it is well worth mentioning that the new product is nonpoisonous, non-absorption of water and oil, no harm to health of children.

9 Claims, 5 Drawing Sheets

(58) Field of Classification Search
CPC ..... A63H 33/106; E04B 1/14; E04B 2/00; E04B 2/18
USPC ..... 446/85, 117–128
See application file for complete search history.

(56) References Cited

U.S. PATENT DOCUMENTS

| | | | | |
|---|---|---|---|---|
| 5,848,927 | A * | 12/1998 | Frederiksen | A63H 33/086 446/128 |
| 7,644,828 | B1 * | 1/2010 | Klein | A63H 33/067 206/509 |
| 2016/0081304 | A1 * | 3/2016 | Nielsen | A01K 15/025 514/772.3 |

FOREIGN PATENT DOCUMENTS

| | | | |
|---|---|---|---|
| CN | 204601631 | U | 2/2015 |
| JP | H0724945 | A | 1/1995 |
| KR | 101279847 | B1 | 1/2013 |

* cited by examiner

HARD-CORE AND SOFT-SHELL TOY BUILDING BLOCKS SET

CROSS REFERENCE TO RELATED APPLICATION

This application is for entry into the U.S. National Phase under § 371 for International Application No. PCT/CN2015/094986 having an international filing date of Nov. 19, 2015, and from which priority is claimed under all applicable sections of Title 35 of the United States Code including, but not limited to, Sections 120, 363, and 365(c), and which in turn claims priority under 35 USC 119 to Chinese Patent Application No. 201520215068.1 filed on Apr. 10, 2015.

FIELD OF THE INVENTION

The present application relates to a building blocks puzzle toy for kids playing, especially a hard-core and soft-shell one.

BACKGROUND OF THE INVENTION

There are two kinds of building blocks: 2D and 3D. These blocks are usually decorated with letters or pictures on their surfaces for patterns of arrangement or building into various styles such as houses or animals so as to develop children's intelligence, one may well say that it is a small thing for big use, particularly it well worth mentioning that the toy building blocks are widely accepted by kids. However, as now available products are usually made into a cubic cordwood or plastic blocks, which feel bad to kids, with poor bounce ability and wearing resistance.

SUMMARY OF THE INVENTION

The present application provides a new utility model patent of toy building blocks set with high wearing resistance and bouncing ability by cladding a thermoplastic polyurethane elastomer rubber layer on the outside surface of polycarbonate matrix.

According to one embodiment of the present application, the hard-core and soft-shell toy building blocks set comprises a polycarbonate matrix having a tenon on its top and several mortise holes underneath; the outside surface of the polycarbonate matrix is cladded with a thermoplastic polyurethane elastomer rubber layer.

Optionally, the hard-core and soft-shell toy building blocks set has at least one mortise hole at the bottom.

Optionally, the shape of tenon is at least one of round, square, triangular, trapezoid, crescent, and heart.

Optionally, the shape of mortise hole is at least one of round, square, triangular, trapezoid, crescent, and heart.

Optionally, the cross-section at the bottom of hard-core and soft-shell toy building blocks set is at least one of round, square, triangular, trapezoid, crescent, heart, "L-shaped" and "T-shaped".

Optionally, when the tenon is round shaped, it has screw thread on its outside surface.

Optionally, the mortise hole is round shaped, the inside surface of the mortise hole has screw thread matching to that on the outside surface of the tenon.

Optionally, the outside surface of tenon has at least one convex part.

Optionally, the inside surface of mortise hole has at least one concave part matching to at least one convex part on the outside surface of tenon.

Optionally, the center zone of the outside surface of polycarbonate matrix has a cave-in pattern.

Said hard-core and soft-shell toy building blocks set in the present application unitizes both conventional hard and soft kinds of cordwood toy by cladding thermoplastic polyurethane elastomer rubber layer on the outside surface of polycarbonate matrix, learning strong points from both to overcome their weaknesses, it produces high bounce ability, high resistance to wearing, bending, high temperature and oxidation, particularly, it is well worth mentioning that the new product is nonpoisonous, non-absorption of water and oil, no harm to health of children.

Wherein: 1, polycarbonate matrix; 2, thermoplastic polyurethane elastomer rubber layer; 3, screw thread on the outside surface of tenon; 4, convex part on the outside surface of tenon.

DETAILED DESCRIPTION

The technical solutions for the present application are at large described by attached figures and embodiments below.

Figure 1:
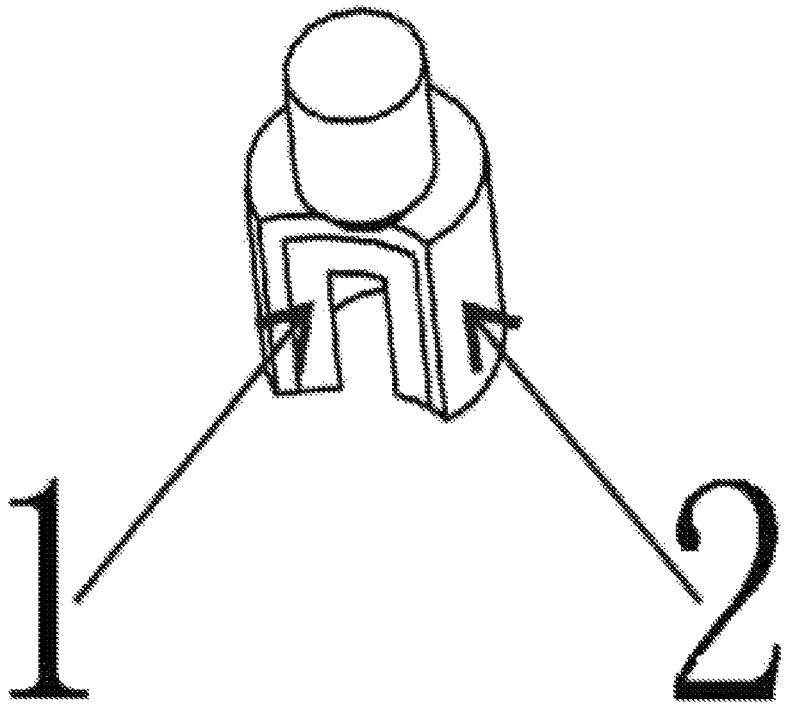
FIG. 1 is the structure diagram of a hard-core and soft-shell toy building blocks set in one embodiment according to the present application.

FIG. 1 is the structure diagram of a hard-core and soft-shell toy building blocks set in one embodiment according to the present application, shown as FIG. 1, this embodiment provides a hard-core and soft-shell toy building blocks set, comprising polycarbonate matrix 1 having a round tenon on its top and one round mortise hole on its round bottom; the outside surface of said polycarbonate matrix 1 is cladded with thermoplastic polyurethane elastomer rubber layer 2.

Said hard-core and soft-shell toy building blocks set provided in the this embodiment unitizes both conventional hard and soft kinds of cordwood toy by cladding thermoplastic polyurethane elastomer rubber layer on the outside surface of polycarbonate matrix, learning strong points from both to overcome their weaknesses, it produces high bounce ability, high resistance to wearing, bending, high temperature and oxidation, particularly, it is well worth mentioning that the new product is nonpoisonous, non-absorption of water and oil, no harm to health of children.

Figure 2:
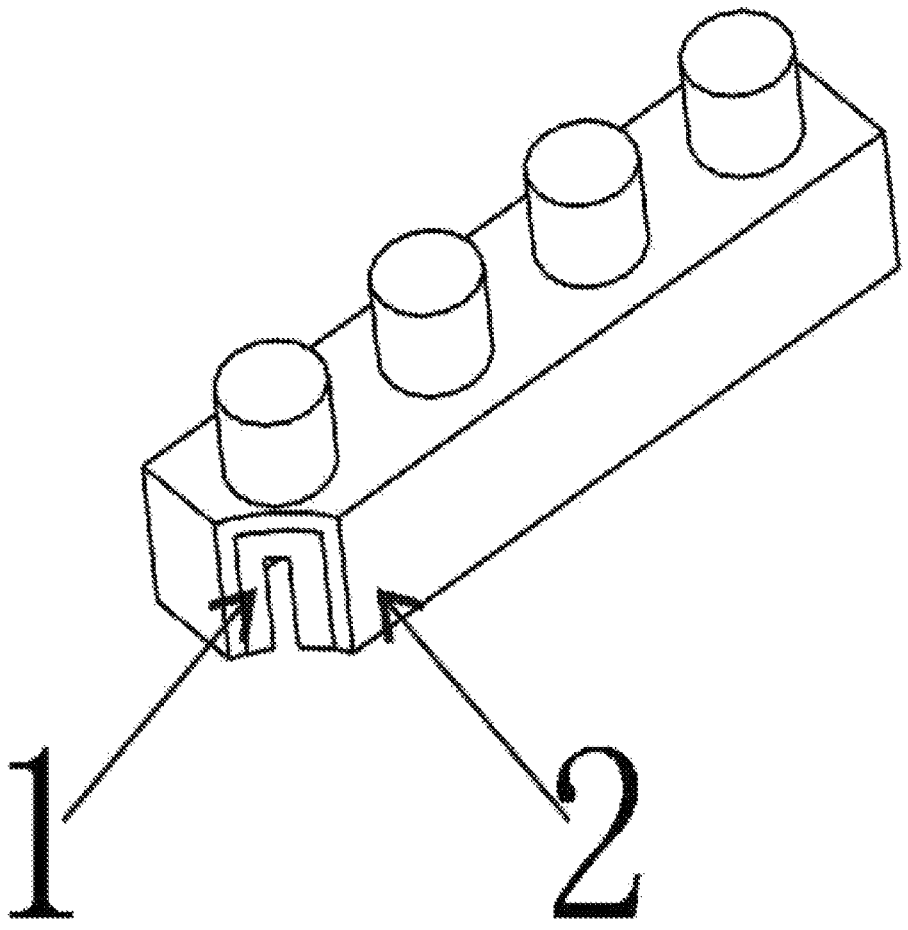
FIG. 2 is the structure diagram of a hard-core and soft-shell toy building blocks set in one embodiment according to the present application.

FIG. 2 is the structure diagram of a hard-core and soft-shell toy building blocks set in one embodiment according to the present application, shown as FIG. 2, this embodiment provides a hard-core and soft-shell toy building blocks set, comprising polycarbonate matrix 1 having a round tenon on its top and four round mortise holes on its square bottom; the outside surface of said polycarbonate matrix 1 is cladded with thermoplastic polyurethane elastomer rubber layer 2.

Said hard-core and soft-shell toy building blocks set provided in the this embodiment unitizes both conventional hard and soft kinds of cordwood toy by cladding thermoplastic polyurethane elastomer rubber layer on the outside surface of polycarbonate matrix, learning strong points from both to overcome their weaknesses, it produces high bounce ability, high resistance to wearing, bending, high temperature and oxidation, particularly, it is well worth mentioning that the new product is nonpoisonous, non-absorption of water and oil, no harm to health of children.

Figure 3:
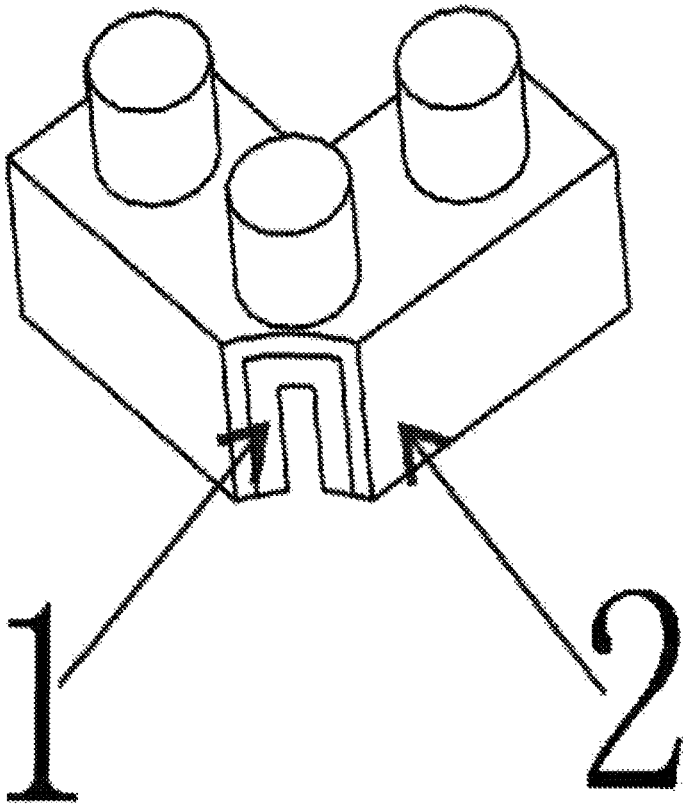
FIG. 3 is the structure diagram of the hard-core and soft-shell toy building blocks set in one embodiment according to the present application.

FIG. 3 is the structure diagram of a hard-core and soft-shell toy building blocks set in one embodiment according to the present application, shown as FIG. 2 and FIG. 3, this embodiment provides a hard-core and soft-shell toy building blocks set, comprising polycarbonate matrix 1 having a round tenon on its top and three round mortise holes on its "L-shaped" bottom; the outside surface of said polycarbonate matrix 1 is cladded with thermoplastic polyurethane elastomer rubber layer 2.

Said hard-core and soft-shell toy building blocks set in the provided in the this embodiment unitizes both conventional hard and soft kinds of cordwood toy by cladding thermoplastic polyurethane elastomer rubber layer on the outside surface of polycarbonate matrix, learning strong points from both to overcome their weaknesses, it produces high bounce ability, high resistance to wearing, bending, high temperature and oxidation, particularly, it is well worth mentioning that the new product is nonpoisonous, non-absorption of water and oil, no harm to health of children.

Figure 4:
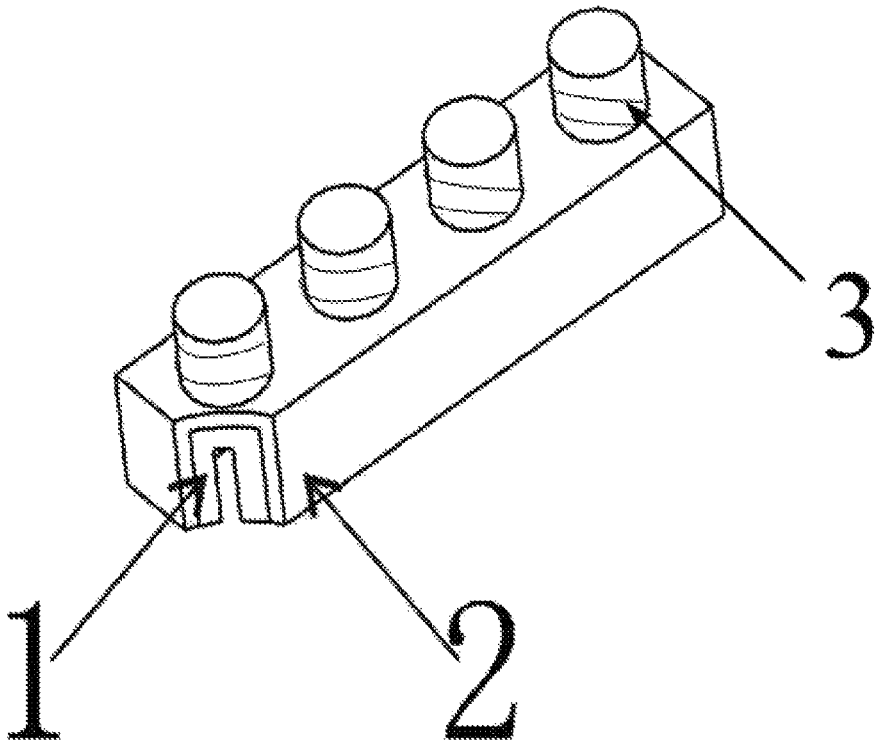
FIG. 4 is the structure diagram of a hard-core and soft-shell toy building blocks set in one embodiment according to the present application.

FIG. 4 is the structure diagram of a hard-core and soft-shell toy building blocks set in one embodiment according to the present application, shown as FIG. 4, this embodiment provides a hard-core and soft-shell toy building blocks set, comprising polycarbonate matrix 1 having a round tenon on its top and one round mortise hole on its round bottom; the outside surface of said polycarbonate matrix 1 is cladded with thermoplastic polyurethane elastomer rubber layer 2.

The hard-core and soft-shell toy building blocks set is designed with at least one mortise hole at the bottom.

The shape of tenon is at least one of round, square, triangular, trapezoid, crescent, and heart.

The shape of mortise hole is at least one of round, square, triangular, trapezoid, crescent, and heart.

It is noted that a round tenon matches to a round mortise hole; a square tenon matches to a square mortise hole; a triangular tenon matches to a triangular mortise hole; a trapezoid tenon matches to a trapezoid mortise hole; a crescent tenon matches to a crescent mortise hole; and a heart shaped tenon matches to a heart shaped mortise hole.

The cross-section at the bottom of hard-core and soft-shell toy building blocks set is at least one of round, square, triangular, trapezoid, crescent, and heart shaped, "L-shaped" and "T-shaped".

As the tenon is round shaped, the outside surface of the tenon has a screw thread.

The mortise hole is round shaped, the inside surface of the mortise hole has screw thread matching to that on the outside surface of the tenon.

The center zone of the outside surface of polycarbonate matrix has a cave-in pattern.

Said hard-core and soft-shell toy building blocks set provided in the this embodiment unitizes both conventional hard and soft kinds of cordwood toy by cladding thermoplastic polyurethane elastomer rubber layer on the outside surface of polycarbonate matrix, learning strong points from both to overcome their weaknesses, it produces high bounce ability, high resistance to wearing, bending, high temperature and oxidation, particularly, it is well worth mentioning that the new product is nonpoisonous, non-absorption of water and oil, no harm to health of children.

Figure 5:
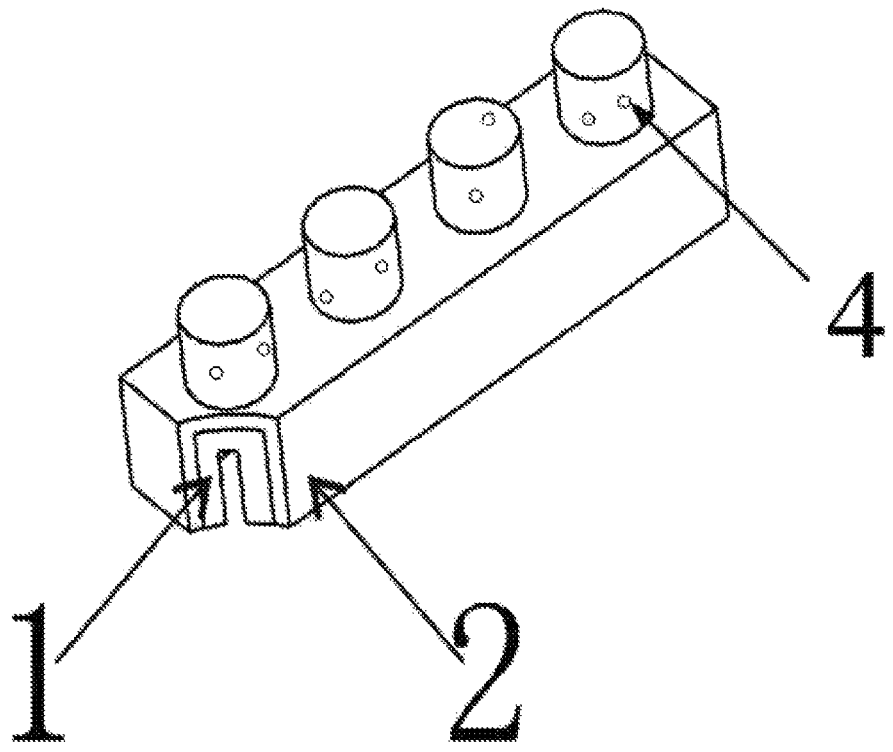
FIG. 5 is the structure diagram of a hard-core and soft-shell toy building blocks set in one embodiment according to the present application.

FIG. 5 is the structure diagram of a hard-core and soft-shell toy building blocks set in one embodiment according to the present application, shown as FIG. 5, this embodiment provides a hard-core and soft-shell toy building blocks set, comprising polycarbonate matrix 1 having a round tenon on its top, and one round mortise hole on its round bottom; the outside surface of said polycarbonate matrix 1 is cladded with thermoplastic polyurethane elastomer rubber layer 2. The outside surface of tenon further has at least one convex part.

The inside surface of mortise hole has at least one concave part matching to at least one convex part on the outside surface of the tenon.

Said hard-core and soft-shell toy building blocks set provided in the this embodiment unitizes both conventional hard and soft kinds of cordwood toy by cladding thermoplastic polyurethane elastomer rubber layer on the outside surface of polycarbonate matrix, learning strong points from both to overcome their weaknesses, it produces high bounce ability, high resistance to wearing, bending, high temperature and oxidation, particularly, it is well worth mentioning that the new product is nonpoisonous, non-absorption of water and oil, no harm to health of children.

All above said embodiments describe at large about purposes, technical solutions, and uses of the present application, it is to be understood that all above said embodiments are only applicable for the present application but not limit to extent of this patent protection, any revision, equivalent substitution and modification done without violating spirit and principle of the present application shall be under the extend of protection from the present application.

The invention claimed is:

1. A hard-core and soft-shell toy building blocks set comprising:

a set of building blocks, wherein each building block comprises:

a polycarbonate matrix having one to four tenons on a top of the polycarbonate matrix and one to four mortise holes underneath;

an outside surface of said polycarbonate matrix is cladded with a thermoplastic polyurethane elastomer rubber layer;

wherein a center zone of the outside surface of said polycarbonate matrix has a cave-in pattern;

wherein the set of building blocks unitize both hard and soft cordwood by cladding the thermoplastic polyurethane rubber layer on the outside surface of the polycarbonate matrix learning strong points from both the hard and soft cordwood to overcome the weaknesses of the hard and soft cordwood.

2. A hard-core and soft-shell toy building blocks set according to claim 1, wherein said hard-core and soft-shell toy building blocks set has at least one mortise hole at the bottom.

3. A hard-core and soft-shell toy building blocks set according to claim 1, wherein the shape of said tenon is selected from the group consisting of: square, triangular, trapezoid, crescent, and heart.

4. A hard-core and soft-shell toy building blocks set according to claim 3, wherein the shape of said mortise hole is selected from the group consisting of: square, triangular, trapezoid, crescent, and heart;

wherein a square shaped tenon matches to a square shaped mortise hole, a triangular shaped tenon matches to a triangular shaped mortise hole, a trapezoid shaped tenon matches to a trapezoid shaped mortise hole, a crescent shaped tenon matches to a crescent shaped mortise hole and a heart shaped tenon matches to a heart shaped mortise hole.

5. A hard-core and soft-shell toy building blocks set according to claim 3, wherein as the shape of said tenon is round, the outside surface of said tenon has screw thread.

6. A hard-core and soft-shell toy building blocks set according to claim 5, wherein the shape of said mortise hole is round, and the inside surface of said mortise hole has screw thread matching to that on the outside surface of said tenon.

7. A hard-core and soft-shell toy building blocks set according to claim 3, wherein the outside surface of said tenon has at least one convex part.

8. A hard-core and soft-shell toy building blocks set according to claim 7, wherein the inside surface of the mortise hole has at least one concave part matching to the at least one convex part on the outside surface of the tenon.

9. A hard-core and soft-shell toy building blocks set according to claim 1, wherein the cross-section at the bottom of said hard-core and soft-shell toy building blocks set is selected from the group consisting of: square, triangular, trapezoid, crescent, heart shaped, "L-shaped" and "T-shaped".

* * * * *